US006017848A

United States Patent [19]

Mando et al.

[11] Patent Number: 6,017,848

[45] Date of Patent: Jan. 25, 2000

[54] HEAT SENSITIVE RECORDING MATERIAL

[75] Inventors: Ritsuo Mando; Koichi Ishida, both of Amagasaki, Japan

[73] Assignee: Oji Paper Co., Ltd., Tokyo, Japan

[21] Appl. No.: 09/139,766

[22] Filed: Aug. 25, 1998

[30] Foreign Application Priority Data

Aug. 25, 1997 [JP] Japan ..... 9-228399
Mar. 6, 1998 [JP] Japan ..... 10-054547

[51] Int. Cl.[7] ..... B41M 5/40

[52] U.S. Cl. ..... 503/226; 427/152; 503/200

[58] Field of Search ..... 427/150–152; 503/200, 226

[56] References Cited

FOREIGN PATENT DOCUMENTS 0 111 335 6/1984 European Pat. Off. .

0 144 155 6/1985 European Pat. Off. .

OTHER PUBLICATIONS

English Abstract of JP, 08–258,426 A—Mori et al.

Yoshida et al, Chemical Abstract, vol. 106, No. 16, Apr. 20, 1987.

Database WPI Section Ch, Week 9650, Class A89, AN 96–501756.

*Primary Examiner*—Bruce H. Hess
*Attorney, Agent, or Firm*—Nikaido, Marmelstein, Murray & Oram LLP

[57] ABSTRACT

A heat sensitive recording material in which a heat sensitive recording layer containing an electron-donating compound and an electron-accepting compound, and a protective layer containing a binder are provided sequentially on a substrate, the binder in the protective layer being diacetone-modified polyvinyl alcohol.

7 Claims, No Drawings

HEAT SENSITIVE RECORDING MATERIAL

The present invention relates to heat sensitive recording materials which generate recorded images by utilizing a color forming reaction between an electron-donating compound and an electron-accepting compound, particularly by utilizing color forming reaction due to thermal energy.

Heat sensitive recording materials are well known which generate recorded images by thermally bringing an electron-donating compound and an electron-accepting compound into contact with each other. Such heat sensitive recording materials are relatively inexpensive, and recording devices therefor are compact and their maintenance are easy. Thus, they are used in a wide variety of fields, as well as recording medium such as facsimiles and various calculators.

As an example of their application fields, there are heat sensitive recording labels for use in POS (point of sales) system and heat sensitive recording tags. Usable environment of heat sensitive recording materials has become severer because of the recent development in heat sensitive recording system. Hence, the preservability of recorded images is also required, in addition to recording suitability.

JP-A-128347/1979 and JP-A-125354/1981 disclose to form a protective layer on a heat sensitive recording layer, as a method for improving preservability.

JP-A-106995/1984 discloses to provide a protective layer with water resistance. By improving the water resistance of a protective layer, however, chemical resistance may decrease, unrecorded areas may discolor with time, the stability of a coating composition for forming a protective layer may decrease, or the like.

JP-A-258426/1996 discloses a heat sensitive recording material in which a heat sensitive recording layer contains a hydrazide compound in order to increase the water resistance of a protective layer. Unfortunately, a sufficient water resistance effect has not been attained.

Accordingly, it is an object of the present invention to provide a heat sensitive recording material which is excellent in color forming ability, water resistance, plasticizer resistance, oil resistance, and also excellent in yellowing resistance in unrecorded areas.

The above and other objects of the invention will become apparent from the following description.

As a means to solve the above problems, in a heat sensitive recording material in which a heat sensitive recording layer containing an electron-donating compound and an electron-accepting compound, and a protective layer containing a binder are provided sequentially on a substrate, the present invention employs diacetone-modified polyvinyl alcohol as a binder added to a protective layer.

The diacetone-modified polyvinyl alcohol serving as a binder in a protective layer is a partially- or completely-saponified copolymer of a monomer having diacetone group and a vinyl ester monomer. This polyvinyl alcohol is prepared by saponifying a resin that is obtained by copolymerizing the monomer having diacetone group with the vinyl ester monomer. The amount of the diacetone-modified polyvinyl alcohol is preferably not less than 10% by weight, more preferably in the range of about 20 to 80% by weight, based on the total solids of a protective layer.

By adding the diacetone-modified polyvinyl alcohol to a protective layer, the diacetone-modified polyvinyl alcohol is easily crosslinked by an insolubilizer, thus minimizing yellowing due to the insolubilizer.

Although the amount of the monomer having diacetone group which has been polymerized in the diacetone-modified polyvinyl alcohol, is not particularly limited, it is preferably in the range of about 0.5 to 10 mole %, more preferably about 1 to 7 mole %, based on the total monomers in the polyvinyl alcohol. Below 0.5 mole %, the water resistance of a protective layer might be lowered. Over 10 mole %, not only water solubility is lowered but also the water resistance as a protective layer might be lowered due to a decrease in film-forming ability.

Although the polymerization degree and saponification degree of the diacetone-modified polyvinyl alcohol are not particularly limited, the former is preferably adjusted in the range of about 300 to 3000, more preferably about 400 to 2000, and the latter is preferably adjusted to not less than 90%.

The vinyl ester used in the above-mentioned copolymerization is not particularly limited. There are, for example, vinyl formate, vinyl acetate, vinyl propionate, vinyl pivalate, and vinyl versatate. Among these, vinyl acetate is preferable industrially.

The monomer having diacetone group is not particularly limited. There are, for example, diacetoneacrylamide, diacetoneacrylate and diacetonemethacrylate. Preferred is diacetoneacrylamide.

As a method of copolymerization between the monomer having diacetone group and vinyl ester, various known polymerization methods such as bulk polymerization, solution polymerization, suspension polymerization and emulsion polymerization are applicable. Among these, a solution polymerization employing methanol as a solvent is preferable industrially.

As a saponification method of resin obtained by copolymerizing the monomer having diacetone group with vinyl ester, the conventionally known alkali saponification and acid saponification are applicable. Preferred is a method in which decomposition with addition of alcohol is conducted by using alkali hydroxide and methanol.

Unless the effect of the present invention is impaired, it is possible to further copolymerize a monomer which is copolymerizable with vinyl ester or a monomer having diacetone group to obtain the diacetone-modified polyvinyl alcohol. Examples of these monomers are unsaturated carboxylic acids such as crotonic acid, acrylic acid and methacrylic acid, and alkyl esters thereof such as methyl or ethyl ester.

A protective layer is formed by applying and drying, on a heat sensitive recording layer, a coating composition for forming a protective layer prepared by mixing and stirring an aqueous solution in which diacetone-modified polyvinyl alcohol is dissolved, together with the following pigment or additive as required.

Examples of pigments are inorganic pigments such as calcium carbonate, zinc oxide, aluminum oxide, titanium dioxide, amorphous silica, aluminum hydroxide, barium sulfate, talc, kaolin, clay and calcined kaolin; and organic pigments such as nylon resin filler, urea-formaldehyde resin filler and raw starch particles. Preferred are kaolin and aluminum hydroxide because they cause only slight decrease in barrier function, namely, provide an effective barrier against chemicals such as plasticizers and oils, and they also cause only slight decrease in recording density. The amount of pigment ranges from 5 to 70% by weight based on the total solids content of a protective layer.

Examples of additives added to a coating composition for forming a protective layer are lubricants such as zinc stearate, calcium stearate, polyethylene wax, carnauba wax, paraffin wax and ester wax; surfactants such as sodium alkylbenzensulfonate, sodium dioctylsulfosuccinate, sulfone-modified polyvinyl alcohol, and sodium polyacrylate; insolubilizers such as glyoxal, boric acid, dialdehyde starch, methylolurea, epoxy compound and hydrazine compound; ultraviolet absorbers; fluorescent dyes; coloring dyes; releasing agents; and antioxidants.

Taking the pot life of the coating composition into consideration, it is desirable to add an insolubilizer into a layer adjacent to a protective layer containing diacetone-modified polyvinyl alcohol. As the layer adjacent to the protective layer, there are, for example, a heat sensitive recording layer, an intermediate layer that can be formed between a heat sensitive recording layer and a protective layer, and an uppermost layer that can be formed on a protective layer. Preferred is a heat sensitive recording layer.

When an insolubilizer is added to a heat sensitive recording layer in order to enhance the water resistance of a protective layer, while taking the pot life of a coating composition for forming a protective layer into consideration, its amount is not particularly limited but preferably in the range of 0.1 to 20% by weight, more preferably about 0.5 to 10% by weight, based on the total solids content of the heat sensitive recording layer.

As an insolubilizer, hydrazine compounds are particularly preferable. Examples of hydrazine compounds are hydrazine and monohydrate thereof, phenylhydrazine, methylhydrazine, ethylhydrazine, n-propylhydrazine, n-butylhydrazine, ethylene-1,2-dihydrazine, propylene-1,3-dihydrazine, butylene-1,4-dihydrazine, benzoic acid hydrazide, formic acid hydrazide, acetic acid hydrazide, propionic acid hydrazide, n-butyric acid hydrazide, isobutyric acid hydrazide, n-valeric acid hydrazide, isovaleric acid hydrazide, pivalic acid hydrazide, adipic acid dihydrazide, phthalic acid dihydrazide, isophthalic acid dihydrazide, terephthalic acid dihydrazide, oxalic acid dihydrazide, malonic acid dihydrazide, succinic acid dihydrazide, glutaric acid dihydrazide, sebacic acid dihydrazide, maleic acid dihydrazide, fumaric acid dihydrazide, itaconic acid dihydrazide, and polyacrylic acid hydrazide.

These can be used solely or jointly. Preferred are dicarboxylic acid dihydrazides such as adipic acid dihydrazide, phthalic acid dihydrazide, isophthalic acid dihydrazide, terephthalic acid dihydrazide, oxalic acid dihydrazide, malonic acid dihydrazide, succinic acid dihydrazide, glutaric acid dihydrazide, sebacic acid dihydrazide, maleic acid dihydrazide, fumaric acid dihydrazide, and itaconic acid dihydrazide. In consideration of the effect of providing water resistance, water solubility and safety, adipic acid dihydrazide is most preferred.

Dicarboxylic acid dihydrazide having carbon number below four can improve reactivity but it may color the unrecorded areas of a heat sensitive recording material red in some cases.

Where a hydrazine compound is incorporated as an insolubilizer into a heat sensitive recording layer, the water resistance of a protective layer can be further enhanced by adding a water-soluble acid compound to the protective layer. Although the amount of the water-soluble acid compound is not particularly limited, it is desirable to add so that a coating composition for forming a protective layer has a pH of between 2 and 6. Below pH 2, the viscosity of the coating composition may abnormally increase, alternatively, fogging may occur in the heat sensitive recording layer. Over pH 6, the water resistance of the protective layer may be lowered. Accordingly, a pH of between 3 and 5 is more preferable.

As a water-soluble acid compound added to a protective layer, various known organic or inorganic acids are usable. There are, for example, inorganic acids such as hydrochloric acid, sulfuric acid, nitric acid and phosphoric acid; and organic acids such as carboxylic acid, sulfonic acid, sulfinic acid, barbituric acid and uric acid. Water-soluble carboxylic acids, i.e., water-soluble organic compounds having carboxyl group, are preferred from the point of view of handling. Examples of the water-soluble organic compounds having carboxyl group are formic acid, acetic acid, propionic acid, butyric acid, valeric acid, caproic acid, oxalic acid, malonic acid, succinic acid, glutaric acid, adipic acid, pimelic acid, fumaric acid, maleic acid, tartaric acid, citric acid, lactic acid, benzoic acid, phthalic acid and benzene tricarboxylic acid.

The present invention is characterized in that a protective layer contains diacetone-modified polyvinyl alcohol as a binder. It is, of course, possible to jointly use other binders, unless the effect of the present invention is not impaired. Examples of useful binders are a completely-saponified polyvinyl alcohol, partially-saponified polyvinyl alcohol, acetoacetyl-modified polyvinyl alcohol, carboxy-modified polyvinyl alcohol, silicon-modified polyvinyl alcohol, starch, starch oxide, hydroxyethyl cellulose, methyl cellulose, carboxymethyl cellulose, gelatin, casein, gum arabic, diisobutylene-maleic anhydride copolymer salt, styrene-maleic anhydride copolymer salt, ethylene-acrylic acid copolymer salt, styrene-acrylic acid copolymer salt, urea resin, melamine resin, amide resin, acrylic resin latex and urethane resin latex.

As a heat sensitive recording system using an electron-donating compound and an electron-accepting compound, there are, for example, the following combinations: a leuco dye and a color developer; diazonium salt and coupler; a chelate compound and a transition element such as iron, cobalt or copper; and an aromatic isocyanate compound and an imino compound. The combination of a leuco dye and a color developer is suitably used because it has high color density. A heat sensitive recording material employing the combination of a leuco dye and a color developer will be described in detail hereafter.

Various known leuco dyes and color developers can be used. Examples of leuco dyes are 3,3-bis(p-dimethylaminophenyl)-6-dimnethylaminophthalide, 3-(4-diethylamino-2-methylphenyl)-3-(4-dimethylaminophenyl)-6-dimethylaminophthalide, 3-(N-ethyl-N-p-tolyl)amino-7-N-methylanilinofluoran, 3-cyclohexylamino-6-chlorofluoran, 3-diethylamino-6-methyl-7-chlorofluoran, 3-diethylamino-7-chlorofluoran, 3-(N-ethyl-N-isoamyl)amino-6-methyl-7-anilinofluoran, 3-(N-methyl-N-cyclohexyl)amino-6-methyl-7-anilinofluoran, 3-diethylamino-6-methyl-7-anilinofluoran, 3-di(n-butyl)amino-6-methyl-7-anilinofluoran, 3-di(n-pentyl)amino- 6-methyl-7-anilinofluoran, 3-(N-ethyl-p-toluidino)-6-methyl-7-anilinofluoran, 3-(N-ethyl-N-tetrahydrofurfurylamino)-6-methyl-7-anilinofluoran, 3-diethylamino-6-chloro-7-anilinofluoran, 3-pyrrolidino-6-methyl-7-anilinofluoran, 3-piperidino-6-methyl-7-anilinofluoran, 3,3-bis[1-(4-methoxyphenyl)-1-(4-dimethylaminophenyl)ethylene-2-yl]-4,5,6,7-tetrachlorophthalide, 3-p-(p-dimethylaminoanilino)anilino-6-methyl-7-chlorofluoran, 3-p-(p-chloroanilino)anilino-6-methyl-7-chlorofluoran, and 3,6-bis(dimethylamino)fluorene-9-spiro-3'-(6'-dimethylamino)phthalide.

The leuco dye is not limited to the above, and two or more kinds of these can be used together. Since the amount of lueco dye differs depending on a color developer to be used, it is difficult to limit its amount, but usually from about 5 to 35% by weight with respect to a heat sensitive recording layer.

Examples of color developers are phenolic compounds such as 4,4'-isopropylidenediphenol, 4,4'-cyclohexylidenediphenol, 2,2-bis(4-hydroxyphenyl)-4-methylpentane, hydroquinone monobenzyl ether, benzyl 4-hydroxybenzoate, 2,4'-dihydroxydiphenylsulfone, 4,4'-dihydroxydiphenylsulfone, 4-hydroxy-4'-isopropoxydiphenyl-sulfone, bis(3-allyl-4-hydroxyphenyl) sulfone, 2,4-bis(phenylsulfonyl)phenol, 4-hydroxy-4'-methyldiphenylsulfone, butyl bis(p-hydroxyphenyl)acetate, methyl bis(p-hydroxyphenyl)acetate, 1,1-bis(4-hydroxyphenyl)-1-phenylethane, 1,4-bis[α-methyl-α-(4'-hydroxyphenyl)ethyl]benzene and 1,3-bis[α-methyl-α-(4'-hydroxyphenyl)ethyl]benzene; compounds having —$SO_2NH$— bond in the molecule, such as p-cumylphenyl N-(p-toluenesulfonyl)carbamoylate, p-benzyloxyphenyl N-(p-toluenesulfonyl)carbamoylate, N-(o-toluoyl)-p-toluenesulfonamide and 4,4'-bis(N-p-toluenesulfonylaminocarbonylamino)diphenylmethane; and zinc salts of aromatic carboxylic acids such as zinc salt of p-chlorobenzoic acid, zinc salt of 4-[2-(p-methoxyphenoxy) ethyloxy]salicylic acid, zinc salt of 4-[3-(p-tolylsulfonyl) propyloxy]salicylic acid and zinc salt of 5-[p-(2-p-methoxyphenoxyethoxy)cumyl]salicylic acid.

The proportions of a lueco dye and a color developer are suitably selected depending on the kind of the lueco dye and color developer to be used. Although they are not particularly limited, a color developer is usually used in the range of 1 to 10 parts by weight, preferably 1 to 5 parts by weight, per part by weight of a lueco dye.

A preservability-improving agent for enhancing the preservation stability of recorded area and a sensitizer for enhancing recording sensitivity can be added to a heat sensitive recording layer. Examples of useful preservability-improving agents are hindered phenol compounds such as 2,2'-ethylidenebis(4,6-di-tert-butylphenol), 4,4'-thiobis(2-methyl-6-tert-butylphenol), 1,1,3-tris (2-methyl-4-hydroxy-5-tert-butylphenyl)butane, 1,1,3-tris(2-methyl-4-hydroxy-5-cyclohexylphenyl)butane, 2,2-bis(4-hydroxy-3,5-dimethylphenyl)propane; epoxy compounds such as 1,4-diglycidyloxybenzene, 4,4'-diglycidyloxydiphenylsulfone, 4-benzyloxy-4'-( 2-methylglycidyloxy)diphenylsulfone, diglycidyl terephthalate, cresol-novolak type epoxy resin, phenol-novolak type epoxy resin, and bisphenol-A type epoxy resin; N,N'-di-2-naphthyl-p-phenylenediamine; sodium or polyvalent metal salt of 2,2'-methylenebis(4,6-di-tert-butylphenyl)phosphate; and bis(4-ethyleneiminocarbonylaminophenyl)methane.

Examples of useful sensitizers are stearic acid amide, stearic acid methylenebisamide, dibenzyl terephthalate, benzyl p-benzyloxybenzoate, 2-naphthyl benzyl ether, m-terphenyl, p-benzylbiphenyl, p-tolylbiphenyl ether, di(p-methoxyphenoxyethyl)ether, 1,2-di(3-methylphenoxy) ethane, 1,2-di(4-methylphenoxy)ethane, 1,2-di(4-methoxyphenoxy)ethane, 1,2-di(4-chlorophenoxy)ethane, 1,2-diphenoxyethane, 1-(4-methoxyphenoxy)-2-(3-methylphenoxy)ethane, p-methylthiophenyl benzyl ether, 1,4-di(phenylthio)butane, p-acetotoluidide, p-acetophenetidide, N-acetoacetyl-p-toluidine, di(β-biphenylethoxy)benzene, di-p-chlorobenzyl oxalate, di-p-methylbenzyl oxalate and dibenzyl oxalate.

Although the amounts of these preservability-improving agents and sensitizers are not particularly limited, it is usually desirable to adjust to not more than 4 parts by weight based on one part by weight of a color developer.

In forming a heat sensitive recording layer, water is usually employed as a dispersion medium, and a leuco dye, a color developer and, if required, a sensitizer, preservability-improving agent and the like, are finely dispersed at the same time or individually so that the mean particle size is not more than 2 μm, by means of a stirring-pulverizing machine such as a ball mill, attritor or sand mill. Thereafter, a coating composition for forming a heat sensitive recording layer which is prepared by adding at least a binder is applied on one surface of a substrate, followed by drying.

Examples of useful binders in the heat sensitive recording layer are starches, hydroxyethyl cellulose, methyl cellulose, carboxymethyl cellulose, gelatin, casein, gum arabic, polyvinyl alcohol, diacetone-modified polyvinyl alcohol, carboxyl-modified polyvinyl alcohol, acetoacetyl-modified polyvinyl alcohol, silicon-modified polyvinyl alcohol, diisobutylene-maleic anhydride copolymer salt, styrene-maleic anhydride copolymer salt, ethylene-acrylic acid copolymer salt, styrene-acrylic acid copolymer salt, urea resin, melamine resin, amide resin, urethane resin latex, acrylic resin latex and styrene-butadiene resin latex.

The amount of the binder is in the range of about 5 to 30% by weight based on the total solids content of a heat sensitive recording layer.

Furthermore, when required, various additives can be added to a coating composition for forming a heat sensitive recording layer. Examples of useful additives are pigments such as kaolin, precipitated (ground) calcium carbonate, calcined kaolin, titanium dioxide, magnesium carbonate, aluminum hydroxide, amorphous silica, urea-formaldehyde resin filler; dispersants such as sodium dioctylsulfosuccinate, sodium dodecylbenzenesulfonate, sodium lauryl alcohol sulfuric acid ester, and metal salts of fatty acids; waxes such as zinc stearate, calcium stearate, polyethylene wax, carnauba wax, paraffin wax and ester wax; insolubilizers such as the above-mentioned hydrazine compounds, glyoxal, boric acid, dialdehyde starch, methylolurea and epoxy compounds; defoaming agents; coloring dyes; and fluorescent dyes.

The method of forming the protective layer and heat sensitive recording layer is not particularly limited. For instance, in an appropriate coating method (e.g., air knife coating, VARI-BAR blade coating, pure blade coating, rod blade coating, short dwell coating, curtain coating or die coating), a coating composition for forming a heat sensitive recording layer is applied and dried on a substrate such as paper (acidic paper or neutralized paper), plastic film, synthetic paper, or non-woven fabric. Then, a coating composition for forming a protective layer is applied and dried on the heat sensitive recording layer.

The amount of a coating composition for forming a heat sensitive recording layer is in the range of about 2 to 12 $g/m^2$, preferably about 3 to 10 $g/m^2$, on dry weight. The amount of a coating composition for forming a protective layer is in the range of about 0.1 to 10 $g/m^2$, preferably about 0.5 to 6 $g/m^2$, on dry weight.

Also, when required, it is possible to provide another protective layer on the rear surface of the substrate of a heat sensitive recording material, to provide an intermediate layer containing an organic or inorganic oil absorbing pigment as a main component between the substrate and the heat sensitive recording layer, or to perform smoothing treatment, e.g., supercalendering, after coating the respective layers. In addition, a variety of techniques well known in the field of heat sensitive recording material are applicable as needed. For example, an adhesive layer may be provided on the rear surface of the substrate of a heat sensitive recording material.

The present invention will be further described with reference to the following examples, which are cited merely by way of example and without limitation. In the examples, "part" and "%" denote "part by weight" and "% by weight", respectively, unless otherwise specified.

EXAMPLE 1

(1) Synthesis of Diacetone-modified Polyvinyl Alcohol

Into a flask equipped with a stirrer, a thermometer, a dropping funnel and a reflux condenser, 670 parts of vinyl acetate, 10 parts of diacetoneacrylamide and 172 parts of methanol were added and the atmosphere in the flask was replaced by nitrogen. Then, the temperature in the flask was raised to 60° C. A solution of one part of 2,2-azobisisobutyronitrile in 50 parts of methanol was added to the flask to initiate polymerization. Over a period of 5 hours from the beginning of polymerization, a solution of 59 parts of diacetoneacrylamide in 39 parts of methanol was added dropwise at a fixed rate. When 6 hours had elapsed, the polymerization was terminated. The polymerization yield was 78%. The remaining vinyl acetate was distilled while applying methanol vapor to the obtained reaction mixture, to obtain 50% solution of vinyl acetate polymer containing diacetoneacrylamide copolymer component in methanol. To 500 parts of this solution, 50 parts of methanol and 10 parts of 4% solution of sodium hydroxide in methanol were added, mixed and stirred, followed by saponification reaction at 40° C. The obtained gel was pulverized, thoroughly washed with methanol and dried to obtain diacetone-modified polyvinyl alcohol. The content of diacetone group was 6.3 mole %, polymerization degree was 1780, and saponification degree was 99 mole %.

(2) Preparation of Coating Composition for Forming Undercoat Layer

A composition composed of 100 parts of calcined clay (oil absorption: 110 ml/100 g), 200 parts of 10% solution of polyvinyl alcohol (saponification degree: 88%; polymerization degree: 1000) and 100 parts of water, was mixed and stirred to obtain a coating composition for forming an undercoat layer.

(3) Preparation of Composition A

A composition composed of 10 parts of 3-di-(n-butyl) amino-6-methyl-7-anilinofluoran, 5 parts of 5% aqueous solution of methyl cellulose and 40 parts of water, was pulverized to a mean particle size of 1.0 $\mu$m by a sand mill, thereby obtaining Composition A.

(4) Preparation of Composition B

A composition composed of 30 parts of 4-hydroxy-4'-isopropoxydiphenylsulfone, 5 parts of 5% aqueous solution of methyl cellulose and 80 parts of water, was pulverized to a mean particle diameter of 1.0 $\mu$m by a sand mill, thereby obtaining Composition B.

(5) Preparation of Composition C

A composition composed of 20 parts of 1,2-di(3-methylphenoxy)ethane, 5 parts of 5% aqueous solution of methyl cellulose and 55 parts of water, was pulverized to a mean particle diameter of 1.0 $\mu$m by a sand mill, thereby obtaining Composition C.

(6) Preparation of Coating Composition for Forming Heat Sensitive Recording Layer A coating composition for forming a heat sensitive recording layer was prepared by mixing together with stirring 55 parts of Composition A, 115 parts of Composition B, 80 parts of Composition C, 160 parts of 10% solution of polyvinyl alcohol (saponification degree: 99%; polymerization degree: 1000), 20 parts of styrene-butadiene latex at a concentration of 50% solids, 17 parts of precipitated calcium carbonate, and 110 parts of 5% aqueous solution of adipic acid dihydrazide.

(7) Preparation of Coating Composition for Forming Protective Layer

A composition composed of 250 parts of 10% aqueous solution of diacetone-modified polyvinyl alcohol as obtained in Preparation (1), 70 parts of kaolin (UW-90, EC Corp.), 6 parts of 30% aqueous dispersion of zinc stearate and 150 parts of water, was mixed and stirred to obtain a coating composition for forming a protective layer. This coating composition had a pH of 6.8.

(8) Preparation of Heat Sensitive Recording Material

The coating composition for forming an undercoat layer was applied and dried on one surface of a wood-free paper weighing 60 g/m$^2$ so that the amount after drying was 7 g/m$^2$, to form an undercoat layer. The surface of the undercoat layer was subjected to smoothing treatment by a supercalender. On the undercoat layer thus treated, the coating composition for forming a heat sensitive recording layer and the coating composition for forming a protective layer were applied and dried so that their amounts after drying were 6 g/m$^2$ and 4 g/m$^2$, respectively, thus sequentially forming a heat sensitive recording layer and a protective layer. The surfaces were then smoothed by a supercalender, to obtain a heat sensitive recording material.

EXAMPLE 2

A heat sensitive recording material was obtained in the same manner as in Example 1 except that in synthesizing the diacetone-modified polyvinyl alcohol, the amount of diacetoneacrylamide was adjusted so that the content of diacetone group was 3.0 mole %. The coating composition for forming a protective layer had a pH of 6.8.

EXAMPLE 3

A heat sensitive recording material was obtained in the same manner as in Example 1 except that in synthesizing the diacetone-modified polyvinyl alcohol, the conditions of polymerization was adjusted so that diacetone-modified polyvinyl alcohol had 500 in polymerization degree, and the amount of diacetoneacrylamide was adjusted so that the content of diacetone group was 3.0 mole %. The coating composition for forming a protective layer had a pH of 6.8.

EXAMPLE 4

A heat sensitive recording material was obtained in the same manner as in Example 1 except that in synthesizing the diacetone-modified polyvinyl alcohol, the conditions of polymerization was adjusted so that diacetone-modified polyvinyl alcohol had 500 in polymerization degree, and the amount of diacetoneacrylamide was adjusted so that the content of diacetone group was 0.7 mole %. The coating composition for forming a protective layer had a pH of 6.7.

EXAMPLE 5

A heat sensitive recording material was obtained in the same manner as in Example 1 except that in synthesizing the diacetone-modified polyvinyl alcohol, the conditions of polymerization was adjusted so that diacetone-modified polyvinyl alcohol had 500 in polymerization degree, and the amount of diacetoneacrylamide was adjusted so that the content of diacetone group was 9.0 mole %. The coating composition for forming a protective layer had a pH of 6.8.

EXAMPLE 6

A heat sensitive recording material was obtained in the same manner as in Example 1 except that in prepaing the coating composition for forming heat sensitive recording layer, 110 parts of 5% aqueous solution of polyacrylic acid hydrazide was used in place of 110 parts of 5% aqueous solution of adipic acid dihydrazide.

EXAMPLE 7

A heat sensitive recording material was obtained in the same manner as in Example 1 except that in prepaing the coating composition for forming heat sensitive recording layer, the amount of 5% aqueous solution of adipic acid dihydrazide was changed to 22 parts from 110 parts thereof.

EXAMPLE 8

A heat sensitive recording material was obtained in the same manner as in Example 1 except that in prepaing the coating composition for forming heat sensitive recording layer, 25 parts of 20% aqueous solution of epoxy insolubilizer [Epiol E-100, Japan PMC Co., Ltd.] was used in place of 110 parts of 5% aqueous solution of adipic acid dihydrazide.

EXAMPLE 9

A heat sensitive recording material was obtained in the same manner as in Example 1 except that in prepaing the coating composition for forming heat sensitive recording layer, 25 parts of 20% aqueous solution of polyamide epichlorohydrin insolubilizer [WS-525, Japan PMC Co., Ltd.] was used in place of 110 parts of 5% aqueous solution of adipic acid dihydrazide.

EXAMPLE 10

A heat sensitive recording material was obtained in the same manner as in Example 1 except that lactic acid was further added to the coating composition for forming protective layer so that the pH thereof was 3.8.

EXAMPLE 11

A heat sensitive recording material was obtained in the same manner as in Example 2 except that lactic acid was further added to the coating composition for forming protective layer so that the pH thereof was 3.8.

EXAMPLE 12

A heat sensitive recording material was obtained in the same manner as in Example 3 except that citric acid was further added to the coating composition for forming protective layer so that the pH thereof was 3.4.

EXAMPLE 13

A heat sensitive recording material was obtained in the same manner as in Example 3 except that tartaric acid was further added to the coating composition for forming protective layer so that the pH thereof was 5.2.

EXAMPLE 14

A heat sensitive recording material was obtained in the same manner as in Example 10 except that in prepaing the coating composition for forming heat sensitive recording layer, 110 parts of 5% aqueous solution of polyacrylic acid hydrazide was used in place of 110 parts of 5% aqueous solution of adipic acid dihydrazide.

EXAMPLE 15

A heat sensitive recording material was obtained in the same manner as in Example 10 except that in prepaing the coating composition for forming heat sensitive recording layer, the amount of 5% aqueous solution of adipic acid dihydrazide was changed to 22 parts from 110 parts thereof.

Comparative Example 1

A heat sensitive recording material was obtained in the same manner as in Example 1 except that in prepaing the coating composition for forming protective layer, 250 parts of 10% aqueous solution of completely-saponified polyvinyl alcohol [PVA-117, Kuraray Co., Ltd.] was used in place of 250 parts of 10% aqueous solution of diacetone-modified polyvinyl alcohol.

Comparative Example 2

A heat sensitive recording material was obtained in the same manner as in Example 1 except that in prepaing the coating composition for forming protective layer, 250 parts of 10% aqueous solution of carboxy-modified polyvinyl alcohol [PVA-KL 318, Kuraray Co., Ltd.] was used in place of 250 parts of 10% aqueous solution of diacetone-modified polyvinyl alcohol.

Comparative Example 3

A heat sensitive recording material was obtained in the same manner as in Example 1 except that in prepaing the coating composition for forming protective layer, 250 parts of 10% aqueous solution of acetoacetyl-modified polyvinyl alcohol [Gohsefimer Z-200, The Nippon Synthetic Chemical Ind. Co., Ltd.] was used in place of 250 parts of 10% aqueous solution of diacetone-modified polyvinyl alcohol.

Comparative Example 4

A heat sensitive recording material was obtained in the same manner as in Example 1 except that in prepaing the coating composition for forming protective layer, 250 parts of 10% aqueous solution of a copolymer of diacetoneacrylamide and acrylamide (molar ratio=1:2) was used in place of 250 parts of 10% aqueous solution of diacetone-modified polyvinyl alcohol.

The following evaluation tests were conducted for the obtained heat sensitive recording materials. The results were shown in Table 1.

[Color Forming Ability]

Each heat sensitive recording material was recorded at an applied energy of 0.35 mJ/dot by a heat sensitive recording tester (Model: TH-PMD, Ohkura Denki Co., Ltd.). The optical density of the recorded area was measured in the visual mode on a Macbeth densitomer (Model: RD-914, Macbeth Corp.). Also, the unrecorded areas were measured in the blue filter mode on the Macbeth densitomer.

[Water Resistance 1]

Each heat sensitive recording material recorded in the same manner as in the above color forming ability test, was immersed in water of 20° C. for 15 hours and dried at an ambient temperature. The optical density of each recorded area was measured in the visual mode on a Macbeth densitomer (Model: RD-914, Macbeth Corp.). Then, the reduction of the optical density of the recorded area was evaluated. The smaller the measured value, the lower the water resistance of the protective layer.

[Water Resistance 2]

Each heat sensitive recording material recorded in the same manner as in the above color forming ability test, was immersed in water of 20° C. for 72 hours and dried at an ambient temperature. The optical density of the recorded area was measured in the visual mode on a Macbeth densitomer (Model: RD-914, Macbeth Corp.). Then, the whitening of the recorded area was evaluated. The smaller the measured value, the lower the water resistance of the protective layer.

[Water Resistance 3]

The protective layer side of each heat sensitive recording material was wet with water, and a corrugated board was pressed on the surface of the protective layer, which was then dried at an ambient temperature. The water resistance of the surface was evaluated depending on the degree to which the heat sensitive recording material was attached to the corrugated board, according to the following evaluation criterion:

Symbol ◎ means that the heat sensitive recording material is separated of itself from the corrugated board;

Symbol ○ means that no peeling of the protective layer surface is observed when the heat sensitive recording material is stripped from the corrugated board;

Symbol Δ means that a slight peeling of the protective layer surface is observed when the heat sensitive recording material is stripped from the corrugated board; and Symbol x means that most part of the protective layer surface are peeled when the heat sensitive recording material is stripped from the corrugated board.

[Water Resistance 4]

One drop (approximately 30 μl) of water was dropped on the protective layer surface of the heat sensitive recording material of 5 cm×5 cm, on which another heat sensitive recording material was then overlapped so that the respective protective layer surfaces were in contact with each other, and dried at an ambient temperature. The water resistance of the surface was evaluated depending on the degree to which the two protective layers were attached to each other when the two heat sensitive recording layers were separated from each other by hand, according to the following evaluation criterion:

Symbol ◎ means that the two protective layers are separated of themselves;

Symbol ○ means that although the two protective layers are attached to each other, the two heat sensitive recording materials are separated easily, with no peeling of the protective layer surfaces;

Symbol Δ means that the two protective layer surfaces are attached to each other, the two heat sensitive recording materials are hard to separate, and some peeling occurs on the protective layer surfaces; and Symbol x means that the two protective layer surfaces are attached to each other, the two heat sensitive recording materials do not separate from each other, thus causing tear.

[Plasticizer Resistance]

A polycarbonate pipe (40 mm in diameter) was wrapped three turns with a wrapping film (KMA-W, Mitsui Chemical Co., Ltd.), and the heat sensitive recording material after being subjected to the recording in the above density measurement, was placed thereon and the wrapping film was further wrapped three turns, which was then left to stand at 40° C. for 24 hours. The optical density of the recorded area was measured by the above Macbeth densitometer to evaluate plasticizer resistance.

[Oil Resistance]

The surface of the heat sensitive recording material after being subjected to the recording in the above recording density measurement, was coated with food oil and then left to stand at 20° C. for 24 hours. The oil was wiped and the optical density of the recorded area was measured by the above Macbeth densitometer to evaluate oil resistance.

[Yellowing Resistance]

Each heat sensitive recording material was left to stand under the conditions of 50° C. and 95% RH for 24 hours. The degree of yellowing of the unrecorded areas was measured in the blue filter mode on the above Macbeth densitometer. The smaller the measured value, the higher yellowing resistance.

TABLE 1

| | color forming ability | | water resistance | | | |
|---|---|---|---|---|---|---|
| | unrecorded area | recorded area | 1 | 2 | 3 | 4 |
| Ex. 1 | 0.08 | 1.37 | 1.20 | 0.74 | ◎ | ○ |
| Ex. 2 | 0.08 | 1.37 | 1.20 | 0.76 | ◎ | ○ |
| Ex. 3 | 0.08 | 1.37 | 1.19 | 0.70 | ◎ | ○ |
| Ex. 4 | 0.08 | 1.37 | 1.16 | 0.66 | ○ | ○ |
| Ex. 5 | 0.08 | 1.37 | 1.12 | 0.72 | ○ | ○ |
| Ex. 6 | 0.08 | 1.37 | 1.03 | 0.69 | ○ | ○ |
| Ex. 7 | 0.08 | 1.37 | 1.11 | 0.69 | ○ | ○ |
| Ex. 8 | 0.08 | 1.37 | 1.01 | 0.84 | ○ | Δ |
| Ex. 9 | 0.08 | 1.37 | 1.06 | 0.87 | ○ | Δ |
| Ex. 10 | 0.08 | 1.37 | 1.33 | 1.15 | ◎ | ◎ |
| Ex. 11 | 0.08 | 1.37 | 1.30 | 1.17 | ◎ | ◎ |
| Ex. 12 | 0.08 | 1.36 | 1.30 | 1.10 | ◎ | ◎ |
| Ex. 13 | 0.08 | 1.35 | 1.26 | 1.08 | ◎ | ○ |
| Ex. 14 | 0.08 | 1.37 | 1.25 | 1.02 | ◎ | ○ |
| Ex. 15 | 0.08 | 1.37 | 1.28 | 1.08 | ◎ | ○ |
| Com. Ex. 1 | 0.08 | 1.35 | 0.56 | 0.33 | X | X |
| Com. Ex. 2 | 0.08 | 1.36 | 0.88 | 0.54 | Δ | X |
| Com. Ex. 3 | 0.09 | 1.35 | 1.24 | 0.81 | ○ | Δ |
| Com. Ex. 4 | 0.08 | 1.35 | 1.14 | 0.75 | ○ | X |

| | plasticizer resistance | oil resistance | yellowing resistance |
|---|---|---|---|
| Ex. 1 | 1.18 | 1.27 | 0.10 |
| Ex. 2 | 1.17 | 1.25 | 0.10 |
| Ex. 3 | 1.16 | 1.24 | 0.10 |
| Ex. 4 | 1.12 | 1.21 | 0.10 |
| Ex. 5 | 1.10 | 1.22 | 0.10 |
| Ex. 6 | 1.01 | 1.13 | 0.10 |
| Ex. 7 | 1.05 | 1.16 | 0.10 |
| Ex. 8 | 1.09 | 1.19 | 0.10 |
| Ex. 9 | 1.11 | 1.20 | 0.10 |
| Ex. 10 | 1.18 | 1.27 | 0.10 |
| Ex. 11 | 1.17 | 1.25 | 0.10 |
| Ex. 12 | 1.16 | 1.24 | 0.10 |
| Ex. 13 | 1.12 | 1.21 | 0.10 |
| Ex. 14 | 1.10 | 1.22 | 0.10 |
| Ex. 15 | 1.12 | 1.27 | 0.10 |
| Com. Ex. 1 | 0.56 | 0.69 | 0.10 |
| Com. Ex. 2 | 0.88 | 0.97 | 0.14 |
| Com. Ex. 3 | 1.26 | 1.29 | 0.25 |
| Com. Ex. 4 | 0.79 | 0.88 | 0.15 |

As apparent from Table 1, the heat sensitive recording materials of the present invention are excellent in color forming ability, water resistance, plasticizer resistance and oil resistance, and they also exhibit excellent yellowing resistance to unrecorded areas.

What is claimed is:

1. A heat sensitive recording material in which a heat sensitive recording layer containing an electron-donating compound and an electron-accepting compound, and a protective layer containing a binder are provided sequentially on a substrate, the binder in the protective layer being diacetone-modified polyvinyl alcohol.

2. A heat sensitive recording material as defined in claim 1 wherein the diacetone-modified polyvinyl alcohol is a polyvinyl alcohol obtained by polymerizing a monomer having diacetone group in the range of 0.5 to 10 mole % based on the total monomers.

3. A heat sensitive recording material as defined in claim 1 wherein an insolubilizer is further incorporated in the heat sensitive recording layer.

4. A heat sensitive recording material as defined in claim 3 wherein the insolubilizer is a hydrazine compound.

5. A heat sensitive recording material as defined in claim 4 wherein the hydrazine compound is a dicarboxylic acid dihydrazide compound.

6. A heat sensitive recording material as defined in claim 1 wherein a water-soluble acid compound is further incorporated in the protective layer.

7. A heat sensitive recording material as defined in claim 6 wherein the water-soluble acid compound is an organic compound having carboxyl group.

* * * * *